US005350125A

United States Patent [19]

Clark

[11] Patent Number: 5,350,125

[45] Date of Patent: Sep. 27, 1994

[54] CONE CRUSHER WITH PERIPHERALLY DRIVEN GYRATORY HEAD

[75] Inventor: Roger M. Clark, Eugene, Oreg.

[73] Assignee: Cedarapids, Inc., Cedar Rapids, Iowa

[21] Appl. No.: 86,534

[22] Filed: Jul. 1, 1993

[51] Int. Cl.[5] ..... B02C 2/04

[52] U.S. Cl. ..... 241/208; 241/207

[58] Field of Search ..... 241/206-209

[56] References Cited

U.S. PATENT DOCUMENTS

| | | | |
|---|---|---|---|
| 970,571 | 9/1910 | Symons . | |
| 1,038,794 | 9/1912 | Sholl | 241/209 |
| 1,083,283 | 1/1914 | Kelly . | |
| 1,241,749 | 10/1917 | McCool . | |
| 2,190,036 | 2/1940 | Morch . | |
| 2,918,877 | 12/1959 | Woodcock . | |
| 3,887,143 | 6/1975 | Gilbert et al. | 241/215 |
| 4,198,003 | 4/1980 | Polzin et al. | 241/215 X |
| 4,477,030 | 10/1984 | Vifian et al. | 241/208 |
| 4,582,267 | 4/1986 | Kohler | 241/214 |
| 4,750,679 | 6/1988 | Karra et al. | 241/209 X |
| 5,115,991 | 5/1992 | Saari | 241/208 |

FOREIGN PATENT DOCUMENTS 496287 4/1930 Fed. Rep. of Germany .

*Primary Examiner*—Douglas D. Watts

*Attorney, Agent, or Firm*—Simmons, Perrine, Albright & Ellwood

[57] ABSTRACT

A conical crusher head of a gyratory cone crusher is supported by a spider arm cradle. Radially disposed and circumferentially evenly spaced spider arm type support members of the cradle extend outwardly through an annular material discharge path in the lower portion of the crusher and through the generally cylindrical frame of the crusher. A gyratory drive mechanism is disposed annularly about the material flow path region and is coupled to the head support members to gyrate the head.

19 Claims, 3 Drawing Sheets

Fig.4.
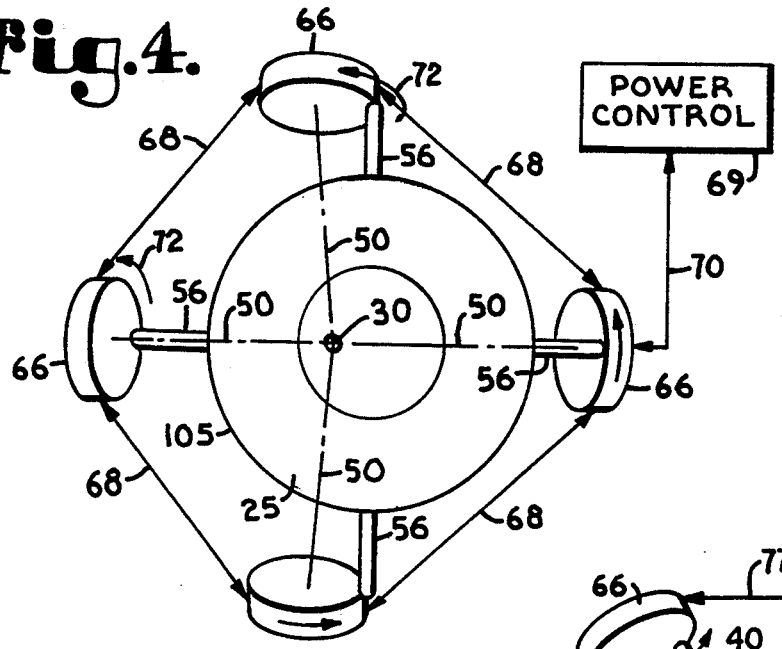
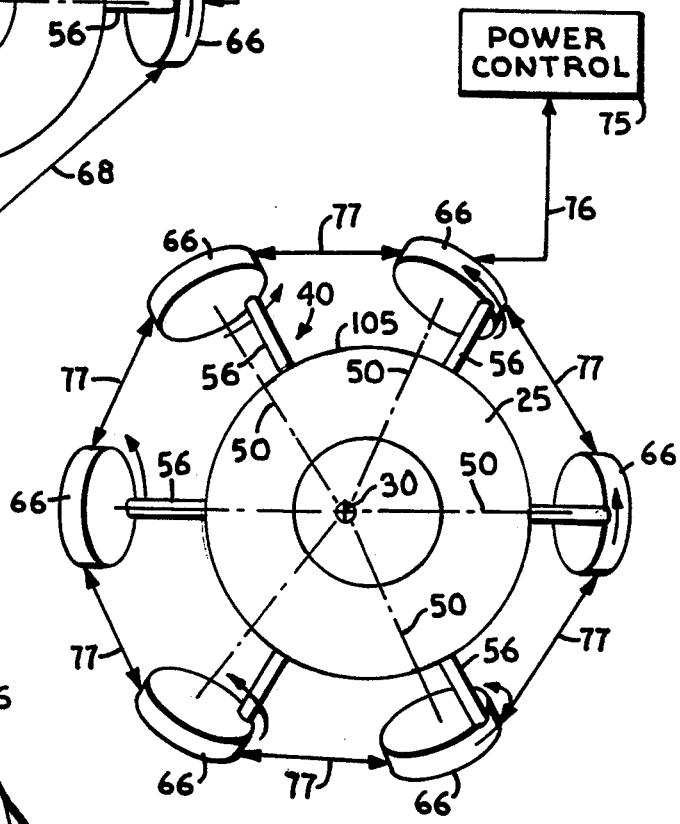
Fig.5.
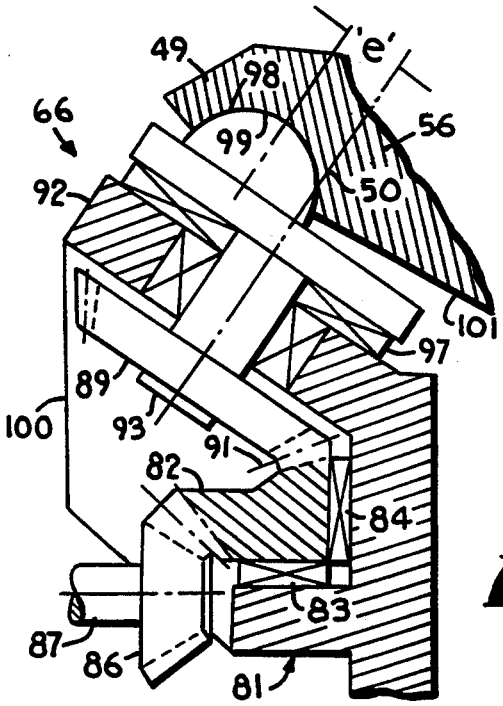
Fig.6.

CONE CRUSHER WITH PERIPHERALLY DRIVEN GYRATORY HEAD

BACKGROUND OF THE INVENTION

The invention relates generally to a gyratory or cone crusher and more particularly to an arrangement for driving a gyratory crusher head of a gyratory or cone crusher.

Gyratory crushers or cone crushers are characterized by cone-shaped crushing heads which are supported to undergo gyratory motion. A crusher head of a gyratory crusher is centered generally about a vertical central axis through the crushers. The gyratory or gyrating motion of the crusher head performs a material comminution action on material as the material moves downward through a space between the head and an inner surface of a concave or bowl-shaped stationary member. The bowl-shaped member or concave is disposed in an inverted position generally over the cone-shaped crushing head. The bowl-shaped member is centered on the vertical central axis of the crusher and has an upper opening through which materials, such as rock, ore, coal or the like are fed into the space between the crushing head and the stationary, bowl-shaped member. The action of the crusher typically distributes the materials annularly about the crushing head. The materials typically move by gravity through the annular space between the inner wall of the stationary bowl member and the outer, cone-like surface of the crushing head. The annular space between the bowl member and the crushing head is also referred to as the crushing chamber. The gyration of the crushing head causes the space at any specific radial position of the crusher to cyclically increase and decrease in size.

State of the art gyratory crushers are generally driven by a horizontally disposed countershaft which radially extends into a lower part of a generally cylindrical crusher housing. An inner end of the countershaft is coupled through a pinion and ring gear to an eccentric bushing or eccentric element to rotatably drive the eccentric element. The eccentric element, in turn, is generally coupled to a connecting shaft of the crusher head to bring about a desired gyratory motion.

A known, but generally accepted, disadvantage of the described gyratory drive arrangement via the countershaft is that crushed materials and the crusher drive share common space in the lower part of the crusher housing. The crushed materials exit through a lower end of the crusher housing, thereby all crushed materials pass peripherally about the drive coupling to the crusher head. Thus, crushed debris accumulates on protective covers of the drive train. As long as no maintenance is required on the crusher, the drive train position in the lower part of the crusher housing may be acceptable. However, the dust and debris which builds up on external crusher drive surfaces coupled with a general inaccessibility of the drive elements in the lower portion of the crushers makes it difficult to maintain the drives of gyratory crushers.

SUMMARY OF THE INVENTION

It is therefore an object of the invention to provide a gyratory crusher with a drive for a gyratory crusher head which drive located away from discharging crushed materials.

It is a further object of the invention to provide a gyratory crusher with a gyratory drive which is readily accessible for maintenance operations.

In accordance with the invention, a gyratory crusher includes a stationary bowl assembly disposed centered on a crusher axis, and a crusher head assembly having a conical crusher head disposed for gyratory motion against a concave crushing liner of the bowl assembly. The crusher head includes a plurality of circumferentially evenly spaced head support members which extend radially through an annular material flow path region of the crusher. A gyratory drive mechanism is disposed annularly about the material flow path region and is coupled to the head support members to gyrate the head.

In a particular embodiment, the gyratory drive mechanism includes a circular stationary drive track which is centered on a central crusher axis and is disposed circumferentially about a crusher housing. The drive track supports an annular eccentric cam with vertical and horizontal camming components. The vertical and horizontal camming components have a resultant which passes through an apex of gyration of the crusher head. The annular eccentric cam is supported by the stationary drive track to rotate about the crusher axis along the drive track.

BRIEF DESCRIPTION OF THE DRAWINGS

The Detailed Description including the description of a preferred structure as embodying features of the invention will be best understood when read in reference to the accompanying figures of drawing wherein:

FIG. 4 shows schematically an alternate eccentric drive arrangement in accordance with the invention;

FIG. 5 shows schematically a variation of the alternate drive arrangement shown in FIG. 4;

FIG. 6 shows a mechanical eccentric drive arrangement as an alternate embodiment of an annular eccentric member shown in FIGS. 1 and 2.

DETAILED DESCRIPTION OF THE INVENTION

Figure 1:
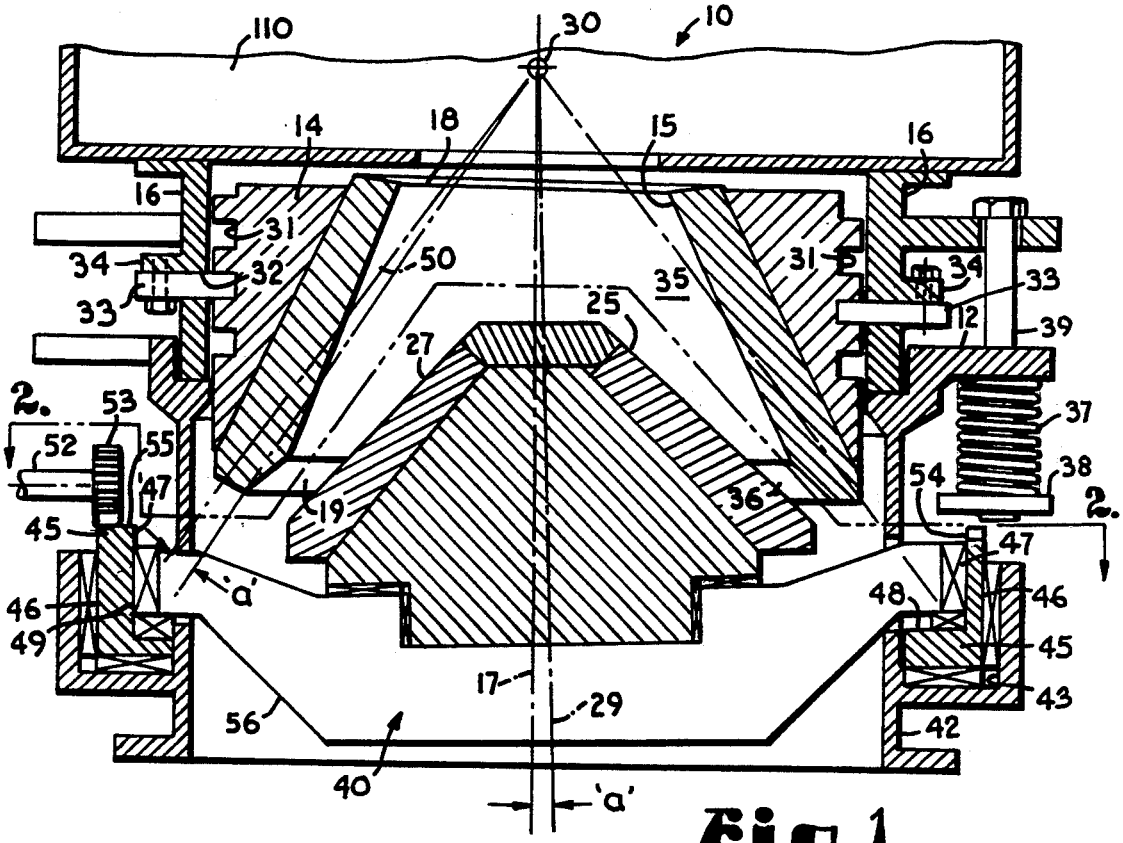
FIG. 1 is a cross-sectional and somewhat simplified side view through a gyratory crusher showing features of the present invention.

In reference to FIG. 1, there is shown, in section and somewhat simplified to highlight particular features of the present invention, a gyratory material comminution apparatus or cone-type crusher which is designated generally by the numeral 10. The sectional view of the crusher 10 shows a crusher frame 12 which generally defines outside dimensions of the crusher 10. The crusher frame 12 may be regarded, in general, as a vertically oriented hollow cylinder. At an upper portion thereof the crusher frame supports a bowl or concave 14. A bowl liner 15 is replaceably mounted to an inner surface of the concave 14. The bowl liner 15 is a typical wear item which may be replaced while the crusher 10 is shut down during maintenance periods. The concave 14 is supported with respect to the crusher frame 12 by a bowl support frame or support structure 16. The support structure 16, the concave 14 and the bowl liner 15 are all centered on a central vertical axis 17 through the crusher 10. The bowl liner 15 has the shape of a hollow truncated pyramid with a first, circular upper opening 18 being more narrow than a second, circular lower opening 19 of the bowl liner 15. The upper opening 18 is a material feed or intake opening of the crusher 10.

Partially located within the bowl liner 15, and extending through the lower opening 19 into the space encompassed by the bowl liner 15, is a crusher head 25 of the crusher 10. The crusher head 25 is generally of a conical shape, having in a preferred embodiment a flattened top or top plate 26. A crusher mantle 27 is replaceably mounted to the crusher head 25 to constitute an outer surface of the crusher head 25. The mantle 27 constitute conically upward facing crushing surfaces of the crusher head 25. The crusher head 25 is generally disposed along the central vertical crusher axis 17. However, a central crusher head axis of symmetry or head axis 29 is disposed and supported at an angle of deviation ("a") with respect to the central vertical crusher axis 17. The central vertical crusher axis 17 and the head axis 29 intersect at a certain point or an apex of gyration 30, simply referred to as an apex 30. The apex 30 is shown to lie in the described embodiment centrally above the crusher 10. During the operation of the crusher 10, the crusher head 25 will gyrate about the apex 30 with respect to the concave 14.

The crushing operation is affected by a correct spacing between the crusher head 25, particularly the mantle 27 and the bowl liner 15. Wear occurring on the respectively facing mantle 27 and the bowl liner 15 tends to increase an originally correct spacing. Consequently, periodic corrective adjustments of the spacing between the mantle 27 and the bowl liner 15 are regarded to be standard routines. The concave 14 has for such purpose external threads 31 which permit the axial position of the bowl or concave 14 to be adjusted in a step-less up or down adjustment by rotating the concave 14 about the central vertical axis 17 with respect to the crusher frame 12, and particularly with respect to the bowl support structure 16.

In distinction over other known bowl support structures which typically feature internal threads to match with external threads on respective bowls, the present bowl support structure 16 has peripherally spaced openings 32 through which extend inwardly toward the concave 14 a plurality of thread lugs 33. The thread lugs 33 may be mounted or fastened in any of a number of known ways, such as by typical machine screws or bolts and nuts, to a corresponding arrangement of external mounting ears 34, also spaced about the cylindrical periphery of the support structure 16 according to the pattern of the openings or apertures 32. The peripheral pattern of the apertures 32 and the mounting ears 34 is a helically advancing and peripherally equally spaced repetition of the combination of one of the apertures 32 and one of the mounting ears 34. A pitch of the helical pattern of the apertures 32 and mounting ears 34 corresponds to a pitch of the external threads 31 of the concave 14. Therefore, as one of the thread lugs 33 is inserted through each respective one of the apertures 32 and is locked or fastened to the respective one of the mounting ears 34, the plurality of inwardly extending thread lugs 33 form in their totality internal threads of the support structure 16. The thread lugs 33 are discrete items. Thus, the helical advance or pitch of the thread lugs 33 may appear to be a multiple of the pitch of the threads 31 on the concave 14, yet be in fact be the same predetermined pitch as that of the threads 31. The thread lugs 33 complement in shape thread grooves of the threads 31. The thread lugs 33 consequently engage the external threads 31 of the concave 14 to retain the concave vertically in an adjusted vertical position with respect to the crusher head 25. The adjusted vertical position of the concave 14 with respect to the crusher head is precisely adjustable by rotation of the concave 14 with respect to the crusher frame 12 and about the vertical central crusher axis 17.

A not immediately apparent advantage of the thread lugs 33 in lieu of conventional threads would be noted during a maintenance shut down, when the bowl liner 15 and the mantle 17 may need to be replaced because they have worn beyond tolerable limits. When such replacement becomes necessary, typically the concave 14 would be threaded out of the support structure until the concave 14 is free of the support structure and may be lifted by a crane (not shown). The presently described structure simplifies removal of the concave 14 from the support structure 16. The concave 14 may, for example, be hooked up to a cable and suspended by a crane (not shown), whereupon the thread lugs 33 are disengaged from the threads 31 of the concave 14. A disengagement of the thread lugs 33 may occur simply by loosening and withdrawing the thread lugs 33 from their engaging positions. The thread lugs 33 may of course be completely removed from the support structure 16 to be replaced prior or during reassembly of the concave 14 to the support structure 16. The removal or disengagement of the thread lugs 33 totally frees the concave 14 from the support structure 16 and permits the concave 14 to be raised with respect to and lifted from the crusher 10. The ability to lift the concave 14 in a straight upward lifting motion from the crusher avoids a tedious job of rotating the concave 14 about the central vertical axis 17 to slowly retract the concave 14 from its lowermost position prior to removing it from the crusher 10. Such slow removal process becomes particularly aggravated when the bowl liner 15 has worn over its useful life cycle and the concave 14 has been adjusted downward on its threads possibly numerous times. Thus, without removing the thread lugs 33, several turns of the concave 14 with respect to the support structure 16 would become necessary to unthread and free the concave 14 from the grip of the support structure 16.

In the described contemplated embodiment, the thread lugs 33 have a substantially rectangular engaging or active shape. It should be understood that other shapes may be equally effective and desirable to use in engagement with the external threads 31 on the concave 14. Also, for simplicity and in accordance with an initially contemplated embodiment, the thread lugs 33 are described and shown as fastened to the mounting ears 34. Advantages of such a structure reside in what may be considered simplicity and convenience of manufacture. It may, however, become desirable to pivotally or slidably assemble the thread lugs 33 to the mounting ears 34. Pursuant to such a modification retraction provisions indicated by an arrow may be used to slide most or all of the thread lugs 33 outwardly to further decrease the time needed in preparation for lifting the concave 14 from the crusher 10. Time may further be saved when the concave 14 with a newly mounted bowl liner 15 is reassembled to the crusher 10. The concave 14 may simply be lowered into the support structure 16 until the proper spacing with respect to the crusher head 25 is achieved, whereupon the thread lugs 33 are engaged with the threads 31 of the concave 14 and are secured with respect to the support structure 16.

Included conical angles of the cones of the bowl liner 15 and the crusher mantle 27 are such that an annular space of a crushing chamber 35 between adjacent surfaces of the bowl liner 15 and the crusher mantle 27 generally decreases downwardly. A remaining annular gap at the lower opening 19 of the bowl liner 15 constitutes an annular material discharge opening 36 from the crushing chamber 35. During the operation of the crusher materials are fed into the crushing chamber 35 through the intake opening 18 and progress downwardly through the annular crushing chamber 35, being reduced in size through repeated crushing contacts between the adjacent walls of the bowl liner 15 and the crusher mantle 27.

A tramp iron relief may be provided by a plurality of preloaded compression springs 37. The springs 37 are equally spaced about the outer periphery of the crusher frame 12 and function to urge the support structure 16 downward against the crusher frame 12. The amount of pre-compression or preload on the springs 37 sets the working limit between the mantle 27 and the bowl liner 15. When the working limit is exceeded by non-crushable material, such as a piece of tramp iron, the concave 14 is urged upward and away from the crusher frame 12 by the gyrating action of the crusher head 25, thereby temporarily widening the spacing between the mantle 27 on the crusher head 25 and the bowl liner 15 of the concave 14. The spacial relief provided avoids a peak increase in crushing forces which would tend to structurally damage the crusher 10. The springs 37 are held under compression between the crusher frame 12 at one end and a movable load plate 38 at the other. A compressive downward force exerted by the compressed springs 37 against the respective load plate 38 is transferred to the support structure 16 of the concave 14 by a plurality of peripherally spaced rods 39.

Figure 2:
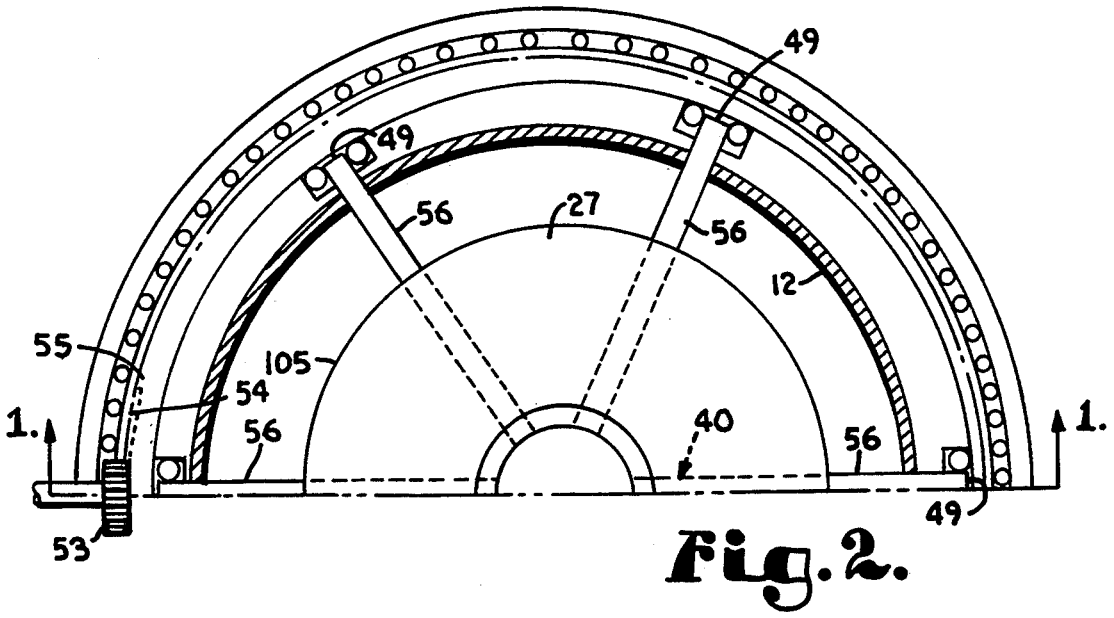
FIG. 2 is a partial top view of the gyratory crusher shown FIG. 1, the gyratory crusher being cut along a central, vertical plane of symmetry through the crusher.
Figure 3:
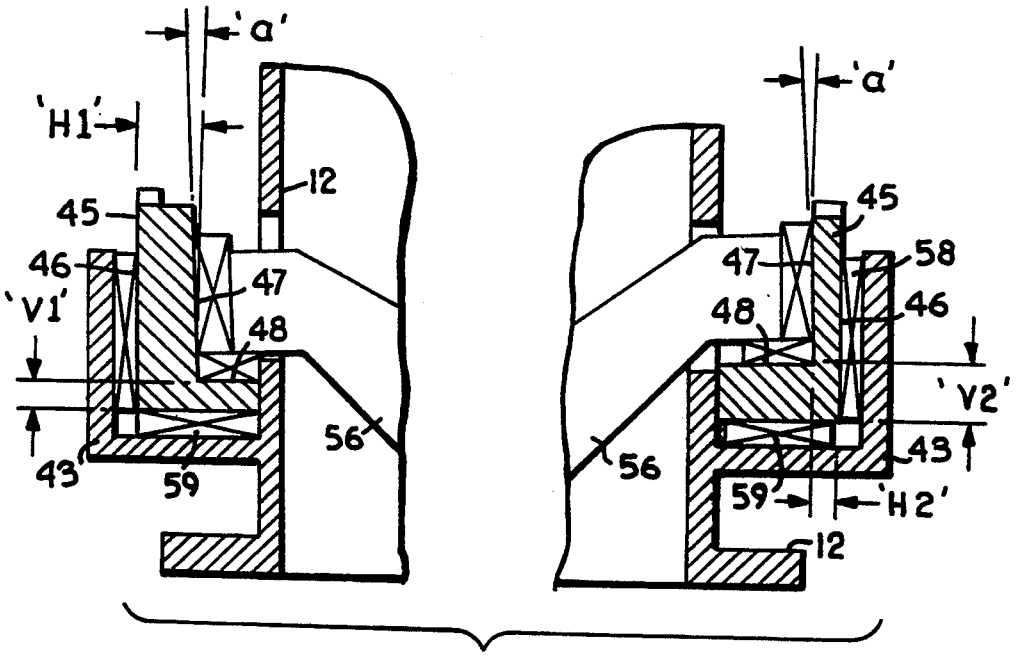
FIG. 3 is a partial section through an annular drive arrangement of the crusher in FIG. 1, showing in greater detail features of the present invention.

The crusher head 25 is supported by a spider arm cradle 40. The spider arm cradle 40 is itself supported by, and mounted for gyratory movement onto, a gyratory drive arrangement 41 which is annularly disposed about a lower portion 42 of the crusher frame 12. In the embodiment of the gyratory drive arrangement 41 as shown in FIGS. 1, 2 and 3, the lower portion 42 of the crusher frame 12 supports an annular drive track 43 which extends peripherally about the crusher frame 12. The drive track 43 may be an integrally manufactured part of the crusher frame 12, as shown, or the drive track 43 may be manufactured separately of the crusher frame 12 and mounted externally of the crusher frame 12 onto the crusher 10 in an assembly operation. Within the drive track 43, there is rotatably supported a double eccentric, gyratory drive ring 45. Though the drive track 43 may be considered part of the somewhat cylindrical crusher frame 12, the drive track 43 is desirably located externally of the generally cylindrical structure of the crusher frame 12, hence away from crushed materials which would generally discharge within the confines of the crusher frame 12. An outer cylindrical bearing surface 46 of the drive ring 45 is concentric with the central vertical crusher axis 17 and supports rotation of the drive ring 45 centered on the axis 17. Horizontal and vertical camming movements are supported by, respectively, horizontal and vertical eccentric surface elements, namely a radial camming surface 47 and an axial camming surface48. The horizontal and vertical camming movements may be represented by horizontal and vertical motion or displacement vectors. The horizontal and vertical motion vectors change cyclically in magnitude and direction. As the drive ring 45 is rotated about the central vertical axis 17, the radial and axial camming surfaces 47 and 48 support outer spider arm ends 49 of the spider arm cradle 40 in circular motion to revolve about a gyratory motion axis 50 which extends through the apex 30. Changes in radial and vertical distances of the radial and axial camming surfaces 47 and 48 represent, respectively, horizontal and vertical components of such cyclic movement of the spider arm ends 49 about their respective axes 50. The deviation angle "a" of the head axis 29 is established by the combination of a horizontal camming movement "H1-H2" and a vertical camming movement "V2-V1", as best seen FIG. 3 showing a maximum excursion of the crusher head 25 toward the right, as is also the position of the crusher head 25 in FIG. 1. The measurements "H1, V1, H2, V2" are taken between an intersection of the respective camming surfaces and the outer cylindrical bearing surface 46 and a base surface 51 of the drive ring 45.

FIG. 2 is a partial top view of the crusher 10 shown in FIG. 1 and depicts a particular embodiment wherein a single revolution of the drive ring 45 about the central vertical axis 17 subjects each of the spider arm ends 49 correspondingly to a full gyration, namely a complete cycle of circular motion about its respective axis of revolution 50 with respect to the apex 30. The drive ring 45 may be driven in any of a number of ways, such as by a countershaft 52 connected to a conventional power plant or power source (not separately indicated). The countershaft 52 as a working end of a power input or power source is coupled through a typical drive pinion 53 to engage a complementary drive gear 54 which may be disposed on an upper surface 55 of the drive ring 45, for example. The top view or plan view also shows the spider arm cradle 40 being formed by spider arms 56 being spaced peripherally by an angle of sixty degrees, such that six spider arms 56 form the complete cradle for supporting the crusher head 25. Instead of a single camming cycle being formed to correspond to a full revolution of the drive ring 45 it may be considered to form a more complex camming surface which, for example, provides 1/6 deflection cycles between each 60 degrees of the altered drive ring (not shown). In the latter example, the linear speed of advance of the drive ring would be reduced to one-sixth of that of the drive ring 45 to obtain the same gyrating rate of the crusher head 25. Camming forces would necessarily be increased over those generated by driving the drive ring 45.

The outer bearing surface 46 and the base surface 51 may be supported for rotation on the drive track 43 by thrust bearings 58 and 59 in the radial and vertical directions, respectively. One alternative to using roller type thrust bearings 58 and 59 may be the use of lubrication oil supported bearing surfaces against corresponding bearing surfaces on the drive track 43. In particular reference to FIG. 3, the spider arm ends 49 may also be supported against the drive ring 45 by roller bearing assemblies 63 and 64, or the spider arm ends 49 may be disposed in the alternative against the respective radial and axial camming surfaces 47 and 48 as oil lubricated sliding cam follower ends. The radial and axial camming surfaces 47 and 48 are shown to be in a position wherein the respective crusher head 25 (see FIG. 1) would have gyrated to its open side setting.

FIGS. 4 and 5 are schematic diagrams of crusher heads 25 being supported by, as examples of choices within the scope hereof, four spider arms 56 and six spider arms 56, respectively. In a crusher design application, the number of spider arms 56 forming a respective spider arm cradle may vary depending on the size of the crusher 10 and the forces which must be supported by the respective gyratory drive arrangement 41. It may be desirable to support a crusher head 25 of a relatively large crusher by a cradle formed of eight, nine or ten spider arms 56. Of course, the size of the crusher 10 may not be the only factor decisive of the number of spider arms 56 used to form a spider arm cradle. The shape, section, and supportive strength of the spider arms 56, and expected crushing forces to be experienced by the crusher 10 may need to be considered. A spider arm cradle 65 having four spider arms 56 shows a possible variation of the number of spider arms toward the low end of the number of spider arms 56 from the already described six spider arm cradle 40. The gyratory motion of a crusher head in a conventional gyratory or cone crusher would typically be generated by an eccentric which revolves about an axis of rotation and which gyrates, in turn, a single shaft of the crusher head at the its speed of rotation. In the present invention, there may be a single eccentric element, such as the drive ring 45 (see FIGS. 1 and 2), which imparts eccentric rotational motion to all of the spider arms 56 and at a phase shift in accordance with their peripheral spacing about the crusher head 25 whereby the crusher head 25 is gyrated.

In reference to FIGS. 4 and 5, a gyration of the crusher head 25 which is the same as the gyration generated by the described drive ring 45 (in FIG. 2) may be generated by a plurality of individual rotational motion generators 66 all of which operate at the same rotational speed, and which eccentrically drive the each of the spider arms 56 to revolve about its respective axis of revolution 50. Thus, each of the motion generators 66 is centered on a respective one of the axes 50, and all motion generators 66 face the apex 30. In the schematic top views, a top or uppermost angular eccentric position of the spider arm 56 with respect to the motion generator 66 corresponds to an outermost position of the elliptic face of the motion generators 66 away from the apex 30. The phase of rotation or the angular position each of the spider arms 56 in its respective circular path of revolution about the respective axis 50 is shifted with respect any other one of spider arms 56 by an angle that corresponds to the peripheral separation angle of the respective two spider arms 56 with respect to each other.

In reference to FIG. 4, synchronization between the individual rotational motion generators 66 is depicted by double-headed arrows 68. The arrows 68 schematically indicate bi-directional feedback communication links 68 between adjacent ones of the motion generators 66. The motion generators 66, for example, may be hydraulic motors 66. The schematically indicated feedback communication links 68 may represent one or more hydraulic fluid lines, or even a combination of hydraulic fluid lines and electrical signal lines to direct or apply hydraulic driving fluid and electrical position signals. In the example of the feedback communication links being hydraulic fluid lines and electrical signal lines, each of the hydraulic motors 66 may be equipped with a position indicator, which may be a known electro-optical position indicator. A power control system 69 may be coupled to drive and control all four of the hydraulic motors 66, as indicated by the double-headed arrow 70. In the present example, the schematic symbol of the arrow 70 represents hydraulic fluid feed and return lines, as well as electrical signal lines for communicating an angular position of each of the respective hydraulic motors 66 to the power control system 69. The power control system 69 synchronizes the speed and angular position of each of the hydraulic motors 66 with respect to each other, such that the phase or angular position of each of the spider arms 56 remains the same with respect to all other spider arms 56.

In FIG. 4, a first hydraulic rotational motion generator 66 (disposed in a "three o'clock" position coupled to the arrow 70) has rotated the respective spider arm 56 to a top position at an instance in a gyratory cycle when the crusher head 25 is in a depicted position which corresponds to that of the crusher head 25 in FIGS. 1 and 2. An exemplary direction of rotation of the motion generators 66 is indicated by arrows 72. To generate an exemplary gyratory motion of the crusher head 25, the direction of motion of all rotational motion generators 66 must be the same as viewed from the apex 30. Looking down on the crusher head 25 in FIG. 4, a second of the motion generators 66 (disposed in a six o'clock position, clockwise displaced by ninety degrees from the first motion generator) shows a position of the corresponding spider arm 56 which leads that of the spider arm associated with the first motion generator by ninety degrees. Correspondingly, the position of the spider arm 56 of a third motion generator 66 in the nine o'clock position, opposite the first motion generator 66, is in a lowermost position being shifted in its positional phase by one-half revolution of the eccentric motion of the respective motion generator 66. The four spider arms 56 of the spider arm cradle 65 in FIG. 4 are, as described, peripherally spaced at right angles or ninety degrees of arc, and a corresponding positional phase shift of adjacent eccentric motion generators is also ninety degrees of arc.

FIG. 5 shows similarly the six-spider-arm cradle 40 which would be of substantially the same structure as the spider arm cradle 40 already described with respect to FIGS. 1 and 2. The six spider arms 56 are, however supported by six individual eccentric motion generators 66. The motion generators 66 in FIG. 5 are also equally spaced about the periphery of the crusher 10. A power control system 75 is shown to be coupled by a drive and communications link 76 to control the motion of the eccentric motion generators 66. FIG. 5 also illustrates that the rotation of all of the eccentric motion generators 66 is in the same direction as viewed from the apex 30, as indicated by the directional arrows 72. Also, the speed of all six of the eccentric motion generators 66 must remain synchronized with respect to each other. Double headed arrows 77 between each two adjacent motion generators 60 illustrate interactive communications or feedback links 77 between the motion generators 66 which synchronize their rotational motion with respect to each other. The eccentric motion generators may, in instead of already described hydraulic motors be electric motors 66 or other eccentric motion generators 66.

FIG. 6 illustrates a mechanical embodiment of an eccentric motion generator 66 which may function in the manner described in reference to FIGS. 4 and 5. A lower portion 81 of the crusher frame 12 is modified to support a drive gear 82. The drive gear 82 is depicted as being rotatably supported on bearings 83 and 84 to rotate peripherally about the crusher frame 12. The bearings 83 and 84 may be roller bearings arranged to support vertical and radial force vectors. The drive gear 84 may be driven along its outer periphery, such as by drive teeth 85 which become engaged by a drive pinion 86 mounted on a horizontally and radially disposed drive countershaft 87. The countershaft 87 is chosen as a typical input from, and represents an output shaft of, a power source 87 to operate the crusher 10.

The drive gear 82 drives a power input gear 89 of each of the peripherally spaced, mechanical eccentric motion generators 66. A second set of drive teeth 91 may be disposed conveniently adjacent a sloped support flange 92 which supports a drive shaft 93 of the eccentric motion generator 66. The drive shaft 93 is centered on the axis of revolution 50 of the eccentric motion generator 66. The drive shaft 93 is journalled for rotation within the flange 92 and is drivably coupled on an upper side of the flange 92 to an eccentric drive plate 96. The drive plate 96 may be supported against the flange 92 by a thrust bearing 97 which may be a roller bearing. The thrust bearing 97 would be chosen to withstand the forces of the crushing operation that are transmitted through the respective spider arm 56 and through a spherical or ball-type toggle link 98 which may be seated within a complementarily shaped socket 99. In that generating crushing forces are ultimately transmitted to and supported by the flange 92 of the crusher frame 12, support gussets or ribs 100 desirably strengthen the support flange 92 on both sides closely adjacent the eccentric motion generators 66. The ball and socket type structure depicted in FIG. 6 is shown in a simple manner for illustrative purposes to emphasize an eccentric offset ("e") which is the radius by which the respective spider arm end 49 revolves about the axis 50. Depending on the size of the crusher 10, and the expected magnitude of crushing forces, the size and, hence, the contact area of the ball link 98 and the corresponding spherical cavity 99 would be increased over the relatively small spherical size of the ball 98 and socket 99 in FIG. 6. With such an increase in bearing area of the ball 98 (the spherical segment of the ball on the drive plate 96) and corresponding socket 99, it is understood that the diameter of the drive plate 96 may correspondingly be increased. End surfaces 101 of the spider arm 56 are chamfered or sloped away from the drive plate 96 to provide clearance for the rotational and resulting gyratory pivotal movement of the spider arms 56 as all of the spider arms 56 are set into motion. Of common departure from the known art in general, is the location of the eccentric motion generators 66 being supported outwardly toward the periphery of the housing or frame 12 of the crusher 10. This is believed to be an advantageous departure from the structures of other existing gyratory crushers. While, in general, gyratory crushers, such as cone crushers, are driven by a countershaft which radially extends to a drive gear disposed generally centrally below the crusher and radially within the annular discharge region of such crushers, the disclosed eccentric motion generating mechanisms are disposed peripherally about such discharge region. The spider arms 56 extend through the material discharge region to impart the gyratory motion to the crusher head 25. Thus the described eccentric drive ring 45 and the individual eccentric motion generators 66 are disposed externally of the crusher frame 12 and away from the annular discharge region about a periphery 105 of the crusher head 25. Advantages in addition to allowing ready access to the eccentric motion generators 66 or to the drive ring 45 are a distribution of crushing forces to the periphery of the crusher 10, particularly to the base of the frame 12. A further advantage as a relatively low crusher profile, as compared to known crushers which have a crusher drive train beneath the crusher frame.

Figure 7:
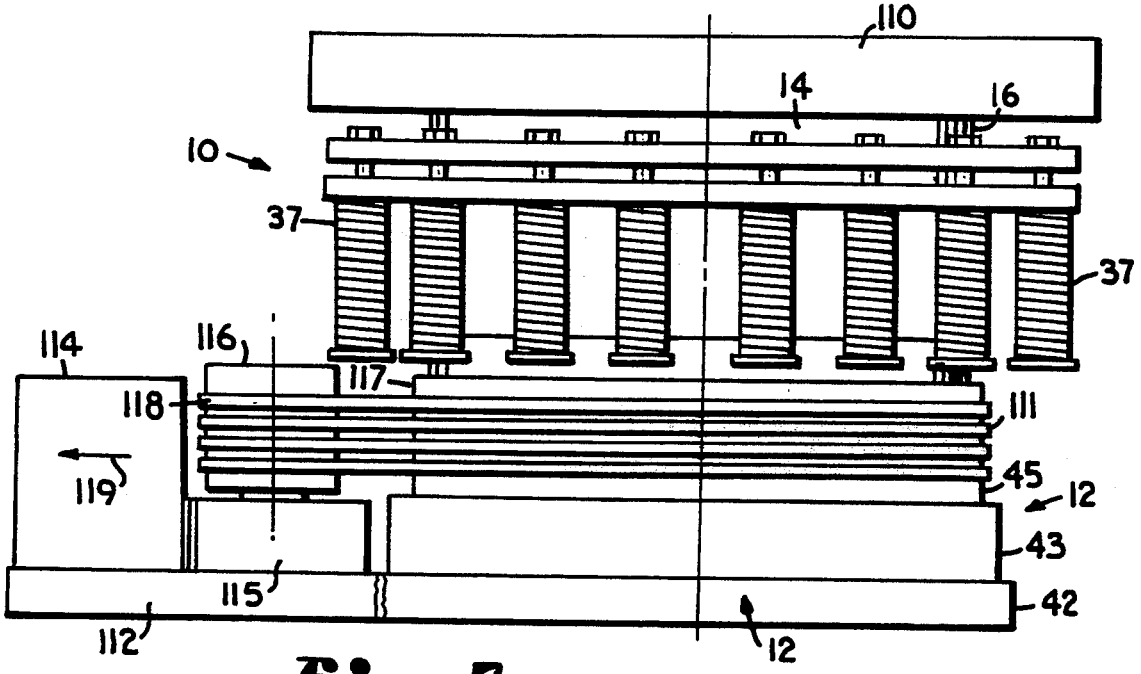
FIG. 7 depicts an overall side elevation of an embodiment of yet another drive arrangement of the crusher shown in FIG. 1.

A comparatively low profile of the crusher 10 in comparison to some known gyratory crushers may be recognized from FIG. 7 showing, somewhat simplified, an overall side elevation of the crusher 10. A material intake hopper or box 110 may be mounted above the upper opening 18 of the crusher 10. The compression springs 37 which hold the concave 14 against the crusher frame 12 prominently encompass an upper part of the crusher frame 12. At the lower portion 42 of the crusher frame 12 the gyratory drive ring 45 extends above the annular drive track 43. Pursuant to the embodiment in FIG. 7 the exposed portion of the gyratory drive ring 45 has a plurality of V-belt grooves 111. The frame 122 is extended or coupled to support frame extension 112 which functions as a motor mount. A power source or power plant 114, such as an engine or an electrical drive motor is mounted to and supported by the support frame extension 112. If a chosen power plant 114 and its position on the support frame extension 112 results in a horizontal power take-off, a right angle drive conversion box 115 may be coupled to the power plant 114 or may also be supported by the support frame extension 112. The right angle drive conversion box 115 or a direct vertical shaft power output 115 of the power plant 114 drives a drive pulley or a V-belt drive sheave 116 about a vertical axis. One or more drive belts 118, for example, a selected number of V-belts 118, depending on power requirements, couple a power input from the power plant 114 via the sheave 116 directly to the gyratory drive ring 45 of the crusher 10. The drive belts 118 extend over both the drive surfaces of the drive sheave 116 and the drive ring 45 and hence couple the drive ring 45 to be driven at the same surface motion of the drive sheave. Belt tightening adjustments may be made in a routine manner by sliding the power plant 114 with the drive sheave 116 in a direction transverse to the axes of the drive sheave 116 and the crusher 10, as indicated by the arrow 119.

As will be realized from the above embodiments of the gyratory crusher the described embodiments are illustrative and specific examples of apparatus to which the invention applies. Various other changes and modification to the described apparatus may be made in view of the above description without departing from the spirit and scope of the invention which is defined by the claims below.

What is claimed is:

1. A gyratory crusher comprising:

a crusher frame;

a concave disposed and supported against an upper end of the crusher frame, the concave having an inner crushing surface sloping radially outward in a downward direction, and having a central material feed opening at an upper portion of the concave and a bottom opening larger than the central material feed opening at a base of the concave;

a spider arm cradle disposed beneath the base of the concave, the spider arm cradle having spider arms extending from generally a vertical centerline through the crusher radially outward beyond the base of the concave;

a crusher head of conical shape disposed on and totaly supported by the spider arm cradle generally centrally within the concave, the crusher head having a conical crushing surface extending adjacent the crushing surface of the concave, the crusher head and the concave being spaced from each other and forming a material crushing chamber there between, the crushing chamber having an annular discharge opening about a periphery of the crushing head;

a spider arm cradle drive disposed annularly about the lower crusher frame portion, the spider arm cradle drive engaging each of the spider arms and moving each spider arm in a rotational path about an axis of rotation, the respective axes of rotation of the spider arms intersecting in an apex of gyration of the crusher head.

2. The gyratory crusher according to claim 1, wherein the spider arm cradle drive comprises a drive ring supported by the crusher frame for annular rotational movement in a plane transverse to the vertical centerline of the crusher, the drive ring having first and second camming surfaces disposed to cyclically move each of the spider arms simultaneously through a cyclic displacement range of horizontal and vertical displacement vectors, which vertical and horizontal displacement vectors have cyclic magnitude changes relative to each other to generate said rotational path about the axis of rotation.

3. The gyratory crusher according to claim 2, wherein one cycle of displacement of the first and second camming surfaces corresponds to one revolution of the drive ring.

4. The gyratory crusher according to claim 3, wherein the spider arm cradle drive further comprises a drive sheave coupled to a power source to rotate in a plane parallel to the plane of rotational movement of the drive ring, and drive belts coupling the drive sheave and the drive ring, such that the drive sheave drives the drive ring.

5. The gyratory crusher according to claim 2, wherein the spider arm cradle drive further comprises a drive sheave coupled to a power source and mounted for rotation in a plane parallel to the plane of rotational movement of the drive ring, and drive belts engaging the drive sheave and the drive ring to couple the drive sheave to rotatably drive the drive ring.

6. The gyratory crusher according to claim 2, wherein the first and second camming surfaces are repetitively convoluted and a camming convolution includes between two adjacent ones of the spider arms one cycle of displacement of a respective spider arm plus that angular portion of a cycle that corresponds to the angular peripheral spacing between adjacent ones of the spider arms.

7. A gyratory crusher comprising:

a crusher frame;

a support structure disposed and urged against an upper end of the crusher frame, the support structure having a plurality of peripherally spaced thread lugs extending inward from the support structure in a helical thread pattern having a predetermined pitch;

a concave having external threads of the same predetermined pitch of the thread lugs, the threads being engaged by the thread lugs to support the concave at a selected height within the support structure;

a crusher head disposed within a lower end of the crusher frame and having upward directed crushing surfaces extending toward the concave;

means for totaly supporting the crusher head vertically with respect to the concave; and means for driving the crusher head in a gyratory orbit with respect to the concave.

8. The gyratory crusher according to claim 7, wherein the means for supporting the crusher head with respect to the concave comprises a spider arm cradle disposed in the lower end of the crusher frame, the spider arm cradle comprising a plurality of spaced spider arms extending radially outward from a central vertical axis through the gyratory crusher, and the means for driving the crusher head in a gyratory orbit with respect to the concave comprises eccentric drive means for driving the spider arms in a circular eccentric path about a gyratory motion axis, the respective gyratory motion axes of each of the spider arms intersecting in a gyratory motion apex.

9. The gyratory crusher according to claim 8, wherein the spider arms are spaced at uniform angular intervals with respect to each other and the eccentric drive means is disposed peripherally about the crusher frame.

10. The gyratory crusher according to claim 9, wherein the eccentric drive means comprises a drive ring disposed peripherally about the crusher frame and supported with respect thereto, the drive ring including an eccentric camming shape having horizontal and vertical surface elements of eccentricity, and means for revolving the drive ring about the crusher frame.

11. The gyratory crusher according to claim 10, wherein the means for revolving the drive ring comprises a drive sheave supported to rotate about an axis parallel to an axis of revolution of the drive ring, and drive belts coupling the drive sheave and the drive ring for joint surface motion.

12. A gyratory crusher of the type which crushes materials between a concave and a gyrating crusher head, comprising:

a spider arm cradle disposed generally centrally within the gyratory crusher, the spider arm cradle having a plurality of spider arms;

a crusher head totaly supported by the spider arm cradle, the spider arms of the spider arm cradle extending outward from the periphery of the crusher head through a material discharge region disposed annularly about the crusher head, the spider arms having respective spider arm ends disposed externally of and annularly about the material discharge region; and means, disposed externally about the material discharge region and engaging each of the spider arm ends for revolving each of the spider arm ends about respective axes of gyration intersecting at an apex, to gyrate the crusher head about the apex of gyration.

13. The gyratory crusher according to claim 12, wherein the means for revolving each of the spider arm ends comprises a plurality of eccentric motion generator means, each coupled to one of the spider arm ends, and each operating synchronously with the others to gyrate the crusher head.

14. The gyratory crusher according to claim 12, wherein the means for revolving each of the spider arm ends comprises a drive ring disposed annularly about, and supported for rotation externally of the material discharge region.

15. The gyratory crusher according to claim 14, wherein the drive ring is an annular drive gear, and the means for revolving each of the spider arm ends comprises a plurality of eccentric motion generator means, each motion generator means coupled to one of the spider arm ends and having an input gear coupled to the annular drive gear, whereby the annular drive gear drives; each of the eccentric motion generators synchronously to gyrate the crusher head.

16. The gyratory crusher according to claim 14, wherein the drive ring comprises first and second camming surfaces engaging each of the spider arm ends, the first and second camming surfaces having horizontal and vertical displacement vectors of cyclic magnitude changes to cyclically revolve each of the spider arm ends through the respective axis of gyration.

17. The gyratory crusher according to claim 16, wherein one revolution of the drive ring corresponds to a single cycle of horizontal and vertical displacement of each of the spider arm ends.

18. The gyratory crusher according to claim 14, further comprising an external drive means for rotating the drive ring.

19. The gyratory crusher according to claim 18, wherein the external drive means comprises a drive sheave driven to rotate in a plane parallel to a plane of rotation of the drive ring, and drive belts coupling the drive sheave and the drive ring, such that the drive sheave drives the drive ring.

* * * * *

UNITED STATES PATENT AND TRADEMARK OFFICE
CERTIFICATE OF CORRECTION

PATENT NO. : 5,350,125

DATED : September 27, 1994

INVENTOR(S) : Roger M. Clark

It is certified that error appears in the above-identified patent and that said Letters Patent is hereby corrected as shown below:

In Column 2, line 37: insert after "shown" --in-- .

In Column 5, line 15: after "crusher", insert --10,-- .

In Column 6, line 19: after "seen", insert --in-- .

In Column 6, line 48: after "provides", delete "1/6" and insert therefor --1-1/6-- .

In Column 8, line 60: after "generators", delete "60" and insert therefor --66-- .

In Column 10, line 25: after "frame", delete "122" and insert therefor --12-- .

In Claim 15, Column 13, line 13: after "drives", delete ";" .

Signed and Sealed this

Fourteenth Day of February, 1995

*Attest:*

Bruce Lehman

BRUCE LEHMAN

*Attesting Officer*

*Commissioner of Patents and Trademarks*